US006224335B1

(12) United States Patent
Parisi et al.

(10) Patent No.: US 6,224,335 B1
(45) Date of Patent: May 1, 2001

(54) AUTOMOTIVE AIR CONDITIONING FAN ASSEMBLY

(75) Inventors: Mark Joseph Parisi, East Amherst; Matthew A. Tanger; Stephan Michael Vetter, both of Lockport, all of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/384,097

(22) Filed: Aug. 27, 1999

(51) Int. Cl.[7] ..... F04D 29/44

(52) U.S. Cl. ..... 415/206; 416/186 R; 416/189; 416/192; 416/223 B

(58) Field of Search ..... 415/204, 206, 415/173.1, 173.5, 173.6; 416/185, 186 R, 187, 188, 189, 192, 223 B, 228, 235

(56) References Cited

U.S. PATENT DOCUMENTS 5,188,508 * 2/1993 Scott et al. ..... 415/206
5,478,201 * 12/1995 Amr ..... 415/206
5,743,710 * 4/1998 Yapp ..... 415/208.2
6,042,335 * 3/2000 Amr ..... 415/208.1

* cited by examiner

*Primary Examiner*—Edward K. Look
*Assistant Examiner*—Richard Woo
(74) *Attorney, Agent, or Firm*—Patrick M. Griffin

(57) ABSTRACT

An automotive air conditioning assembly has a fan that is molded by a technique that inevitably leaves the lower hub and upper rim radially staggered relative to one another. Therefore, a substantial length of the edges of the blades' bases are unsupported by the incomplete hub, and the air forced radially outwardly between the blades has no fan structure to confine it at that point. The invention provides a fan housing having a wall portion specially shaped so as to provide the air confinement function that the missing section of the fan hub cannot.

3 Claims, 4 Drawing Sheets

AUTOMOTIVE AIR CONDITIONING FAN ASSEMBLY

TECHNICAL FIELD

This invention relates to air conditioning and ventilation systems in general, and specifically to centrifugal fan assembly therefor.

BACKGROUND OF THE INVENTION

U.S. Pat. No. 5,588,803 describes some of the basic structural and manufacturing issues involved in producing molded plastic centrifugal fans for automotive air conditioning systems. The ultimate in molding simplicity is a one piece design, which can be made only by designing the fan with a shape that is amenable to the so called axial draw or by pass molding technique. In order to be moldable by that technique, the part, be it a fan or anything else, must have a certain structural relationship relative to its central axis, such as the central axis of a bearing cage or the central axis of a fan. All "upper" and "lower" surfaces of the part must be divisible in such a way that they have no radial overlap with one another. If so designed, all part surfaces may be divided up so that some can be molded by one die, and the rest by the other die, and the pair of dies (or molds) can be pushed together and pulled apart freely along the same central axis. This represents the absolute minimum both in terms of the number of molds used (two) to produce the part, and the number of pieces (one) in the part produced.

A dilemma is faced in designing a centrifugal fan with such a "no radial overlap" design, especially for so called rearwardly inclined fan blade designs, which are wide in the radial direction. Both the lower blade bases and the upper blade tips need adequate structural support. The blade bases may be easily integrally molded to the central area of the fan, which has a thick center hub. However, to provide complete support to the upper tips of the blades, an upper ring is needed, which is axially spaced from the hub, and inevitably overlaps with it. The issue then becomes the best way to physically attach this non integral blade tip supporting ring. This may be done by separate fasteners, heat staking, or, as in the above referenced patent, by a twist lock technique.

This is not to say that it's impossible to by pass mold a plastic centrifugal fan, even one with radially wide blades. A design capable of being molded that way is relatively simple, and an example of such a design is disclosed in U.S. Pat. No. 5,352,089. The design involves basically splitting off the radially outermost section of the hub at an imaginary cylindrical line and moving it up to support the tips of the fan blades. Then, the two molds can part along that imaginary cylinder, which is arrayed around the central axis. Inevitably, the entire width of the base and tips of the blades cannot both be structurally supported, however. Only the radially inner portions of the base of the fan blades are supported, by the hub, and the radially outer portions are unsupported by the hub. Likewise, only the radially outer portions of the tips of the blades are supported, by the upper rim, and the radially inner portions are unsupported. Sufficient structural stiffness can be achieved simply by making the hub, rim and blades thick enough, of course.

However, in a two piece fan design, the hub at the blade bases, and the radially overlapped ring at the blade tips, provide more than just blade stiffness. The air that is pulled axially in and then driven radially outwardly between the blades is also confined between the axially opposed lower hub and upper ring. The upper ring generally slopes axially downwardly relative to the lower hub (to maintain a constant volume as the radius increases), and both the hub and ring generally slope axially downwardly relative to the air capturing, torroidal volute that surrounds the fan. With a by pass molded, one piece fan design, both the hub and upper ring are "incomplete," and cannot alone do an efficient job of confining the radially outwardly moving air stream. For example, in the design disclosed in U.S. Pat. No. 5,352,089, the unsupported outer portions of the blade bases are simply left wide open, decreasing the effectiveness of the fan assembly as a whole.

SUMMARY OF THE INVENTION

An automotive air conditioning fan assembly according to the present invention is characterised by the features specified in claim 1.

In the preferred embodiment disclosed, a centrifugal fan with the same basic "split lower hub and upper ring" design described above is incorporated within a housing that uniquely cooperates therewith to compensate for the fact that the axial space between the blades in not totally bounded or confined by the fan itself. The housing volute is configured with a circumferentially continuous inner wall which, in effect, takes the place of the inevitably missing outer section of the hub. The volute wall has a cylindrical inner coaming that surrounds and is closely radially opposed to the terminal edge of the fan hub. Air driven outwardly by the fan blades, therefor, does not have a large leak path available through the fan hub-volute wall clearance. From its inner coaming, the volute wall slopes radially out and axially down, generally matching and closely paralleling the contour of the hub. In the embodiment disclosed, the edges of the unsupported outer portions of the fan blade bases also closely follow the contour of the volute wall, with a close clearance. Therefore, air moving radially outwardly between the blades is axially well confined between the volute wall and the axially opposed upper rim of the fan.

BRIEF DESCRIPTION OF THE DRAWINGS

These and other features of the invention will appear from the following written description, and from the drawings, in which.

DESCRIPTION OF THE PREFERRED EMBODIMENT

Figure 1:
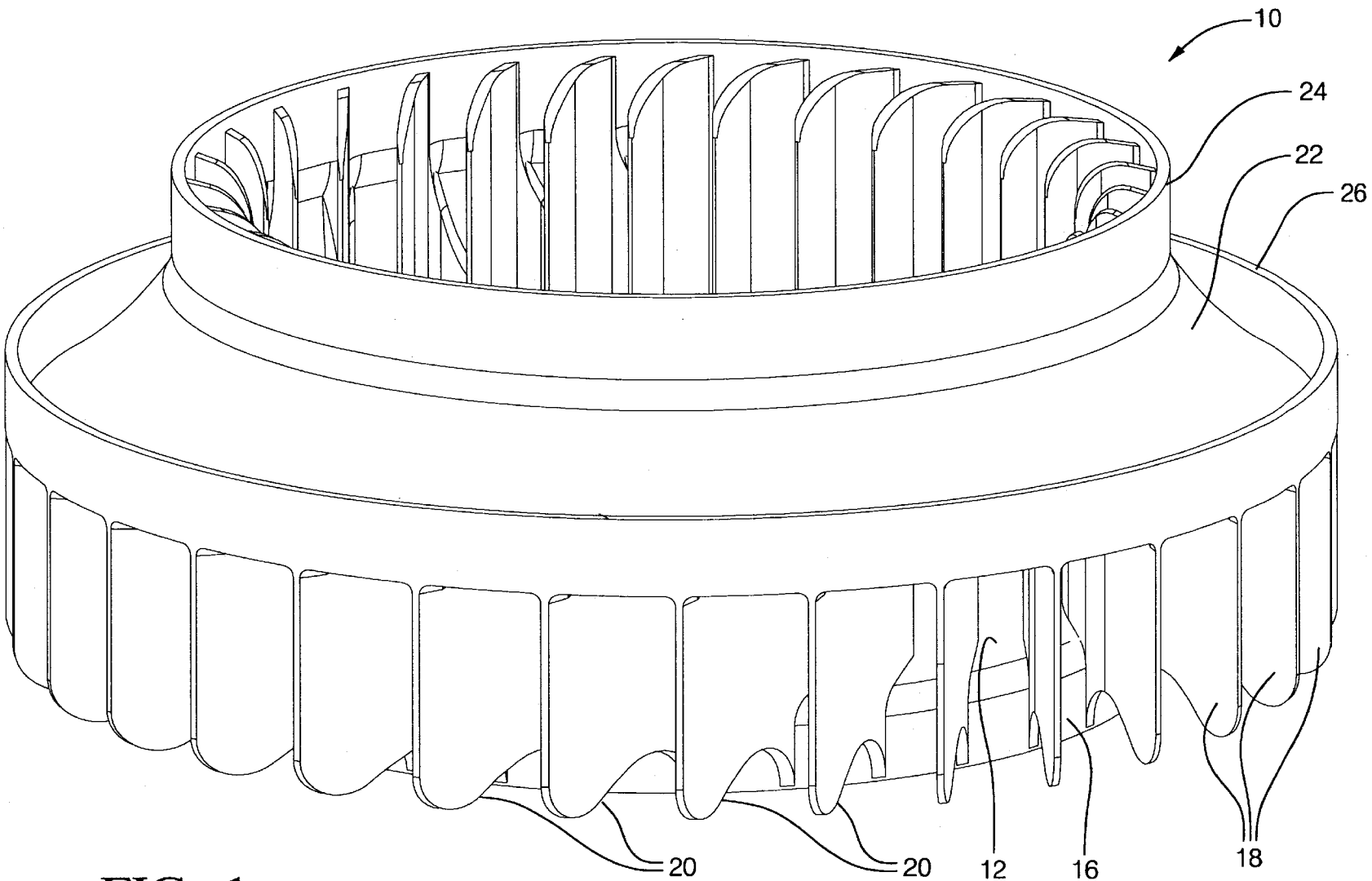
FIG. 1 is a perspective view of a centrifugal fan incorporated in the fan assembly of the invention.
Figure 2:
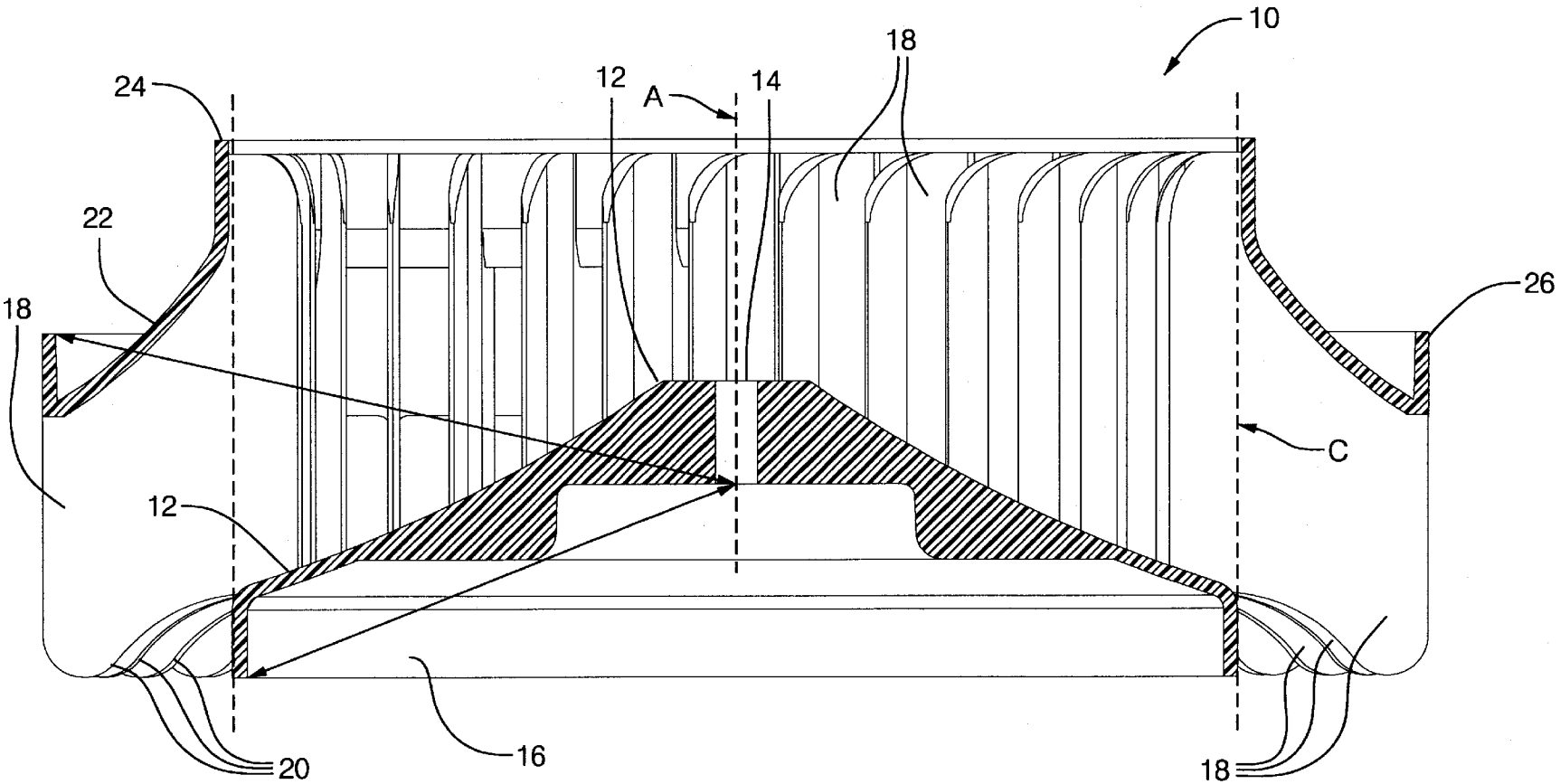
FIG. 2 is a cross section through the fan of FIG. 1.

Referring first to FIGS. 1 and 2, a molded plastic centrifugal fan, indicated generally at 10, is generally defined about a central axis A, and also spins about the same axis in operation. The structural foundation of fan 10 is a central hub 12, which is basically an annular disk that slopes radially outwardly and, in the particular embodiment disclosed, axially downwardly from, a center bore 14 that lies on axis A. Bore 14 is the attachment point the motor shaft that spins the fan 10, and the bottom point of bore 14, indicated at X, is the point relative to which the fan 10 would bend or vibrate if unbalanced. Hub 12 is as thick and as structurally stiff as it practically can be, within cost and weight constraints, but it does not, and cannot, extend radially all the way out to the radial outermost edge of fan 10. Instead, it ends at a cylindrical outermost edge, in this case, a lower cylindrical flange 16, disposed about axis A. As indicated by the double headed arrow in FIG. 2, the lower flange 16 is diagonally opposed to the point X, that is, it is spaced both radially outwardly from and axially below the point X. Lower flange 16 is also located just radially inboard of an imaginary cylinder C, which is also coaxial to central axis A. A series of circumferentially spaced, radially disposed blades 18 have the radially inner portion of their bases integrally molded with, and supported by, the central hub 12. That support ends, however, at the imaginary cylinder C, where hub 12 ends. Radially outboard of cylinder C, the lower edges 20 of the bases of blades 18 are open and unsupported. Those unsupported lower edges 20 continue to slope radially outwardly and axially downwardly from flange 16, for a significantly greater distance than the supported inner portion of the bases of blades 18, continuing on with the basic contour and shape of the hub 12. Axially above the hub 12, a generally annular rim 22 slopes radially outwardly and axially downwardly from an inner lip 24 to a circular terminal edge in the form of an upstanding cylindrical flange 26. Inner lip 24 lies just radially outboard of the cylinder C, while flange 26 is contiguous to the outer edges of the tips of the blades 18. Upper flange 26, like lower flange 16, is diagonally opposed to, but axially above, the point X. The flanges 16 and 26 help to stiffen the fan 10, but also provide conveniently located structures on which to place balance weights, or from which to shave material, or both, so as to dynamically balance fan 10 relative to its attachment point X. They also provide other functions, described below.

Figure 3:
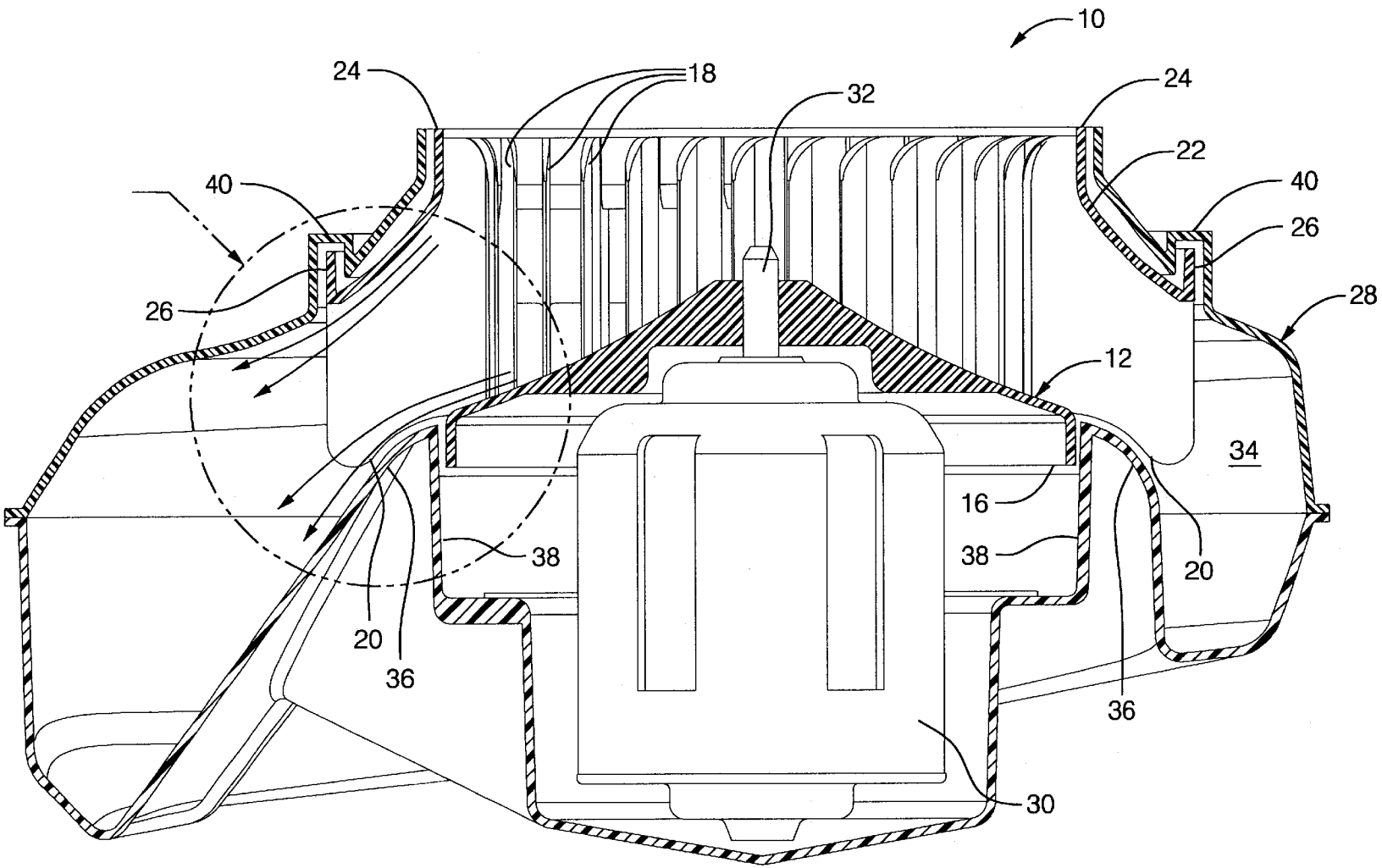
FIG. 3 is a cross section of the whole fan assembly.
Figure 4:
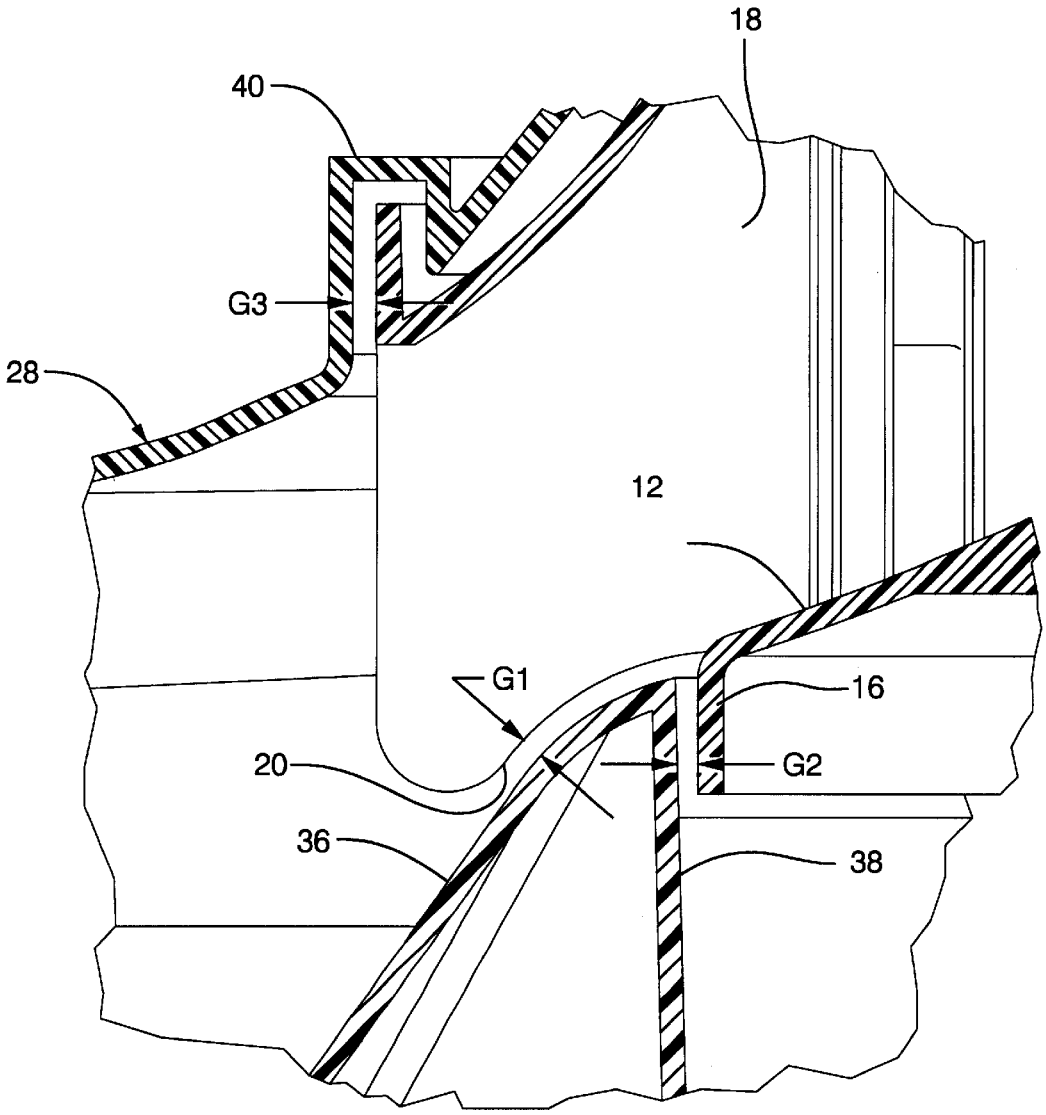
FIG. 4 is an enlargement of the directed portion of FIG. 3.

Referring next to FIGS. 3 and 4, a fan housing, indicated generally at 28, encases a motor 30 with central shaft 32, which is attached through bore 14 to fan 10. The outer reaches of housing 28 comprise a generally torroidal volute 34 that surrounds the fan 10, and which acts as a trough to catch and gather the pressurized air forced radially outwardly by fan 10. The volute 34 increases in width and volume at its outer perimeter, moving around its circumference, and also moves axially down, so as to move the pressurized air radially outwardly and axially down to a non illustrated outlet. The inner perimeter of volute 34 comprises a lower wall portion 36 that has a substantially constant size and shape. Generally, as best seen in FIG. 4, wall portion 36 slopes radially out and axially downwardly in a contour that generally matches and continues the contour of the fan hub 12, beyond the flange 16 where hub 12 ends. Specifically, wall portion 36 runs below and parallels the open, unsupported lower edges 20 of the bases of the blades 18, with a slight, substantially constant clearance therefrom, indicated at G1, of 2–8 millimeters. Wall portion 36 has a generally circular inner edge in the form of an integral, cylindrical coaming 38, which is radially opposed to and spaced from fan lower flange 16 by a clearance G2 of similar size. The upper wall of housing 28 includes an annular, upstanding trough 40 that surrounds the upper fan flange 26 with a clearance G3 comparable in size range to G1 and G2.

Referring again to FIG. 3, the operation of fan 10 within housing 28 is illustrated. As fan 10 is spun by motor 30 about its central axis, air is pulled axailly in from above, and through the open, unsupported inner edges of the tips of blades 18. This unsupported tip length, standing out from lip 24, is not particularly long, and a much greater proportion of the blade tip is supported by rim 22 than is unsupported, so blade tip stiffness is not an issue. Air pulled axially in is then forced radially outwardly between the blades 18, axially confined below by the upper contoured surface of the fan hub 12, and above by the inner surface of the fan rim 22. However, since the hub 12 and rim 22 cannot radially overlap one another, they are never axially opposed, and cannot concurrently axially confine the moving air stream physically between them. Instead, as the air moves radially outwardly (as shown by the arrows) it moves past the radial gap G2, with little pressure loss, because of the controlled size of G2. Thereafter, the air stream smoothly follows the contour of the housing wall portion 36, because of the fact that it continues on with the basic contour of the upper surface of hub 12 (sloping axially down and radially out), and because of the fact that it is so closely spaced relative to the open, unsupported lower edges 20 of the fan blades 18. Above the hub 12, the air stream smoothly follows the contour of the upper blade rim 22, flowing past the upper flange 26 with minimal pressure loss, due to the tightly controlled radial gap G3. Upper blade rim 22 is axially opposed to the housing wall portion 36, and slopes down even more steeply, thereby maintaining a relatively constant total volume as the confined area expands with the growing radius. Thus, before as it is expelled from between the fan blades 18, the air stream is forced radially out and axially downardly into the volute 34 under pressure. The closely contoured housing wall portion 36, with its particular shape and closely controlled gap G1, makes up for and replaces the "missing" portion of the hub 12, cooperating with the fan rim 22. An operation comparable to a two piece fan is achieved, that is, a fan in which the hub can and does run radially out all the way along the entire base of the blades. This performance is achieved by a molded, one piece fan, however, which is inherently less costly to manufacture and handle.

Variations in the disclosed embodiment could be made. For example, the outer edge of hub 12 could be abrupt and sharp, instead of the cylindrical flange 16 shown, just as the inner edge of wall portion 36 could be sharp, rather than the cylindrical coaming 38 disclosed. However, the flange 16, being concentric to the cylinder C, can be created without mold pull interference, and provides both extra fan stiffness, as well as extra axial length to the gap G2, which aids in non contact sealing. The coaming 38, as well, can be easily molded and provides extra axial length to the gap G2. The same considerations apply to the upper flange 26 and the way it fits within trough 40. That is, rim 22 could also end, instead, an abrupt edge, but upper flange 26 provides the same benefits as the lower flange 16, and the two flanges 16 and 26, as noted above, together provide improved fan balancing potential. The upper surface of hub 12 and the wall portion 36 could be sloped axially downwardly to a lesser degree, even nearly flat, in a case where the volute itself did not recede in the axial direction, so long as they still essentially matched each other in shape and contour.

What is claimed is:

1. An automotive air conditioning fan assembly having a centrifugal fan with a central axis, a lower, generally disk like central hub sloping radially outwardly and axially downwardly from said central axis to a generally circular terminal edge, an upper, generally annular rim axially spaced from said hub and sloping radially outwardly from a generally circular inner edge to a generally circular outer edge, said hub terminal edge and said rim inner edge lying substantially on the same imaginary cylinder, without radial overlap, said fan also having a plurality of radially extending, circumferentially spaced, and axially disposed fan blades, said blades being supported only at a radially outer portion of their upper ends by said hub and supported only at a radially inner portion of their lower ends by said rim, said fan blades also having open unsupported lower edges that extend radially beyond said imaginary cylinder and axially downwardly said fan assembly also having a fan housing within which said fan is enclosed, a drive motor that spins said fan about its axis, and a generally torroidal volute surrounding said fan into which air driven radially outwardly between said fan hub and rim is collected under pressure, characterized in that, said fan housing volute has a circumferentially continuous lower wall portion generally contoured to match the slope and shape of said fan hub, said lower wall portion running below and parallel to said open, unsupported fan blade lower edges with a substantially constant clearance therefrom in the range of 2 to 8 millimeters, said lower wall portion having a generally cylindrical inner edge circumferentially surrounding said fan hub terminal edge and closely radially opposed thereto, whereby air driven by said fan transitions smoothly along said hub and wall portion and into said volute without substantial pressure loss through the unsupported radially inner portion of the fan blade lower ends.

2. A fan assembly according to claim 1, further characterized in that said fan central hub terminal edge comprises a cylindrical flange and said lower wall portion inner edge comprises a cylindrical coaming concentric thereto.

3. A fan assembly according to claim 1, further characterized in that said fan rim circular outer edge comprises a cylindrical flange.

* * * * *